US007889079B2

(12) United States Patent
Albahri

(10) Patent No.: US 7,889,079 B2
(45) Date of Patent: Feb. 15, 2011

(54) ANTI SECURITY SYSTEM FOR MANHOLE COVERS

(75) Inventor: Tareq Abduljalil Albahri, Safat (KW)

(73) Assignee: Kuwait University (KW)

( * ) Notice: Subject to any disclaimer, the term of this patent is extended or adjusted under 35 U.S.C. 154(b) by 367 days.

(21) Appl. No.: 12/135,153

(22) Filed: Jun. 7, 2008

(65) Prior Publication Data

US 2009/0303043 A1 Dec. 10, 2009

(51) Int. Cl.

| | |
|---|---|
| ***G08B 13/14*** | (2006.01) |
| ***G08B 21/00*** | (2006.01) |
| ***G08B 13/08*** | (2006.01) |
| ***G08B 15/00*** | (2006.01) |
| ***E02D 29/14*** | (2006.01) |
| ***E01C 19/32*** | (2006.01) |
| ***E01C 19/35*** | (2006.01) |
| ***E01C 19/34*** | (2006.01) |

(52) U.S. Cl. ..... 340/568.1; 340/686.1; 340/545.2; 340/545.6; 404/25; 404/133.1; 404/133.2; 116/12; 52/20

(58) Field of Classification Search ..... 340/686.1, 340/568.1, 541, 542, 545.1, 547, 545.6, 500–506, 340/539.13, 545.2, 568.2, 571, 3.1, 825.36, 340/825.49; 52/20; 116/6, 12, 75, 85, 100; 404/25, 133.05, 133.1, 133.2

See application file for complete search history.

(56) References Cited

U.S. PATENT DOCUMENTS

| | | | | |
|---|---|---|---|---|
| 5,012,766 | A * | 5/1991 | Nigawara et al. | 122/504 |
| 7,009,513 | B2 * | 3/2006 | Dang | 340/545.1 |
| 7,589,630 | B2 * | 9/2009 | Drake et al. | 340/539.26 |
| 7,612,664 | B2 * | 11/2009 | Huang et al. | 340/539.31 |
| 2005/0196239 | A1 * | 9/2005 | Dennis | 404/25 |
| 2006/0284427 | A1 * | 12/2006 | Borycki | 292/240 |
| 2008/0155064 | A1 * | 6/2008 | Kosuge et al. | 709/219 |
| 2008/0165001 | A1 * | 7/2008 | Drake et al. | 340/550 |

FOREIGN PATENT DOCUMENTS

| | | | |
|---|---|---|---|
| GB | 2267106 | A * | 11/1993 |
| JP | 2003074081 | A * | 3/2003 |
| WO | WO 2007/014697 | * | 12/2007 |

* cited by examiner

*Primary Examiner*—Jennifer Mehmood
(74) *Attorney, Agent, or Firm*—Richard C. Litman

(57) ABSTRACT

There is disclosed an antitheft security alarm system and method for manhole covers, rainwater drains, and the like, to prevent burglary of the cover by transmitting a wireless alarm signal to a remote station when the cap is removed to notify a dispatch center or other notification message recipient of the burglary incident and location. The security apparatus may be an integrated unit, including sensors, a telemetry unit, a power supply, a processor, and supporting hardware, all located in an enclosed, waterproof housing. The security alarm system apparatus is adapted to fit within a manhole cavity without the need for extensive or alteration of existing manhole structures.

10 Claims, 6 Drawing Sheets

ANTI SECURITY SYSTEM FOR MANHOLE COVERS

FIELD OF THE INVENTION

The field of the present invention relates generally to antitheft security alarm systems and methods and, more particularly, to devices and methods for monitory the burglary of manhole covers such as the ones used in sewers, storm drains, waterways, and the like.

BACKGROUND OF THE INVENTION

Most municipalities have a rainwater and sanitary wastewater system, the purpose of which is to collect and transport waste water from the various drains, disposals and other sources within the community to a sewage treatment plant or other facility.

Wastewater and rainwater manhole covers are frequently stolen and sold as scrap metal for their value in many cast-iron related industries. Burglary of the manhole covers usually occurs in rural areas where police and public supervision is lacking and manholes are overlooked. Theft of manhole covers has become a phenomenon in many countries costing a lot of money. The price is usually associated not only with the price of one cover but with the price of many replacements that follow since these replacements are stolen again thus requiring an effective solution that apprehends the burglars and permanently stop the wastage. In addition, open manholes are dangers to both health and property.

To solve the adobe problems it is proposed to provide the manhole cover with a security alarm system that dials a remote security office to take action in apprehending the burglars during the burglary. The installation of such antitheft alarm system is justifiable considering the cost, social and safety factors mentioned above.

PRIOR ART REFERENCE AND DISCUSSION

There exist commercially many designs for cast-iron manhole covers featuring anti-theft bolt or locking mechanism but not manhole cover antitheft alarm systems. Many companies sell manhole covers with locking mechanisms such as shown in FIG. 6 from "global source" (http://www.hardware.globalsource.com/gol/I/Cast-metal/a/9000000066183.htm). More information is available on the internet regarding antitheft manhole covers with locking mechanisms but I am not aware of any public uses for antitheft alarm systems for the manhole covers.

Several U.S. patents disclose using manhole covers antitheft methods comprising of locking mechanisms such as bolys, L-shaped locks and the like. Front page copies as well as complete PDF copies of the same are provided in the enclosed CD for reference. These prior art antitheft methods for securing the manhole cover using mechanical means are not effective because they can be tampered with and original lock openers (mating turn keys) are easily obtainable. In addition, these locks do not provide enough preventive measure since they can be cut-open using a torch. Furthermore, these types of covers are costly (the price of a unit like the one shown in FIG. 6 starts from US$60, for a minimum order of 500 units) which is about the same price of a remote alarm unit featuring better security. Moreover, antitheft mechanical locking mechanisms are prevention methods meant to stop intrusion and burglary but not apprehend the burglars and as such they are not deterrent and do not stop future crime.

Several U.S. patents disclose using alarm systems associated with manhole covers for the purpose of preventing intrusion to underground facilities or to report hazardous water and gas level. Copies of these patents on are provided in the enclosed CD for reference. None of these discloses using the alarm system for antitheft of manhole covers themselves.

Among the prior art literatures that describe antitheft manhole cover alarm system are the U.S. and foreign patents discussed below the teachings of which are incorporated herein by reference.

Chinese patent CN2514034Y (2002) to Li Giangdi and Japanese patents JP6158676 (1994) to Tadashi et al., JP54136744 (1979) to Shiyouichi, JP2001002280 (2001) to Katsu, disclose providing an alarm system to alert a hazardous situation of an open manhole to prevent personal injury and damage to property. The disclosure does not claim the alarm to function for the purpose of antitheft of the manhole covers.

Japanese Patent no. JP58017934 (1983) to Masato and Japanese Patent application no. 2002269664 (2002) to Shogo et al. discloses using a control system of manhole with an alarm function and signal transmission to alert for the hazardous generation of a gas, spring water and the like. The disclosure does not claim the alarm to function for the purpose of antitheft of the manhole covers.

U.S. Patent Application no. 20040084359 (2004) to Pasko discloses a manhole cover liquid level monitoring system with an alarm circuit and a wireless communication device. The disclosure does not claim the alarm to function for the purpose of antitheft of the manhole covers.

U.S. patent application Ser. No. 7,002,481 (2006) to Crane, et al. discloses a monitoring system comprising a depth measurement sensor positioned in sewer manholes, storm drains, etc. to obtain water level measurements and report dangerous water level back to the remote monitoring station. An additional sensor, oriented upwards instead of downwards, may monitor disturbances to the manhole cover for security purposes. The monitoring method is based on dept measurement and can be deceived by using a substitute cover to burglar the manhole cover. In addition, the upward sensor may not work if covered with water and dirt and produces false readings. Furthermore, the disclosure does not claim the alarm to function for the purpose of antitheft of the manhole covers.

U.S. Pat. No. 6,764,261 (2004), World Patent no. WO2004015212 (2004) both to Stadler and Japanese patent JP2001279969 (2001) to Kinshi et al. disclose a mechanical locking method and device for manhole covers, and the like. The locking device is provided with a radio transmitter beneath the manhole cap to transmit an alarm signal when the lock is opened and cap removed. The disclosure claims using the invention for intrusion purposes and does not specifically claim to function for the purpose of antitheft of the manhole covers.

PRIOR ART

What is the general common knowledge in the industry as to the subject matter of the invention?

There exists commercially many designs for cast-iron manhole covers featuring anti-theft bolt or locking mechanism such as L-shaped locks and the like.

There also exist some patents for alarm systems associated with manhole covers but for the purpose of preventing intrusion to underground facilities or report hazardous water or gas level and not antitheft of the covers themselves.

Prior Related Patents

Several US patents disclose using alarm systems in connection with manhole covers for preventing intrusion to underground facilities or to report hazardous conditions such as high water or gas levels and not for antitheft of the manhole covers themselves. Patents that describe manhole covers antitheft methods comprise locking mechanisms not antitheft alarm system. Front page copies as well as complete PDF copies of the same are enclosed in the enclosed CD for reference.

Prior Publications

Some information is available on the internet regarding manhole covers antitheft locking mechanisms but not manhole cover antitheft alarm systems.

Prior Public Uses and/or Sales

There exists antitheft manhole covers with locking mechanisms but I am not aware of any public uses for antitheft alarm systems for manhole covers.

Prior Work Done by

Many companies sell manhole covers with locking mechanisms such as "global source" http://www.hardware/globalsources.com/gsol/l/Cast-metal/a/9000000066183.htm Patents on alarm systems are provided in enclosed CD for reference.

In what respects is the Invention Different from the Prior Art mentioned earlier?

1. Prior art describe manhole covers antitheft mechanical locking mechanisms and the invention here relates to manhole covers antitheft alarm security system.
2. Prior art further describe alarm systems in connection with man hole covers for preventing intrusion to underground facilities or to report hazardous conditions such as high water or gas levels and not for antitheft of the manhole covers themselves.

Accordingly, it is an object of the present invention to provide the manhole cover with a security alarm system which avoids the disadvantages of the prior art.

SUMMARY OF THE INVENTION

In view of aforementioned problems we hereby propose to provide a solution that would provide for a security alarm system that dials a remote security office take action in apprehending the burglars of the manhole cover during the burglary and thus work as deterrent for future burglaries. There is disclosed an antitheft security alarm system and method for manhole covers, rainwater drains and the like, to prevent burglary of the cover by transmitting a wireless alarm signal to a remote station when the cap is removed to notify a dispatch center or other notification message recipient of the burglary incident and location. The security apparatus may be an integrated unit, including sensors, a telemetry unit, a power supply, a processor, and supporting hardware, all located in an enclosed, waterproof housing. The security alarm system apparatus is adapted to fit within a manhole cavity without the need for extensive or alteration of existing manhole structures.

BRIEF DESCRIPTION OF THE DRAWINGS

The above and other aspects, features, and advantages of the present invention will be better and more fully understood by those skilled in the art with reference to the following detailed an more particular description of specific and preferred embodiments thereof, resented in conjunction with the following drawings to show how the same may be carried into effect, wherein.

DETAILED DESCRIPTION OF THE INVENTION

Figure 1:
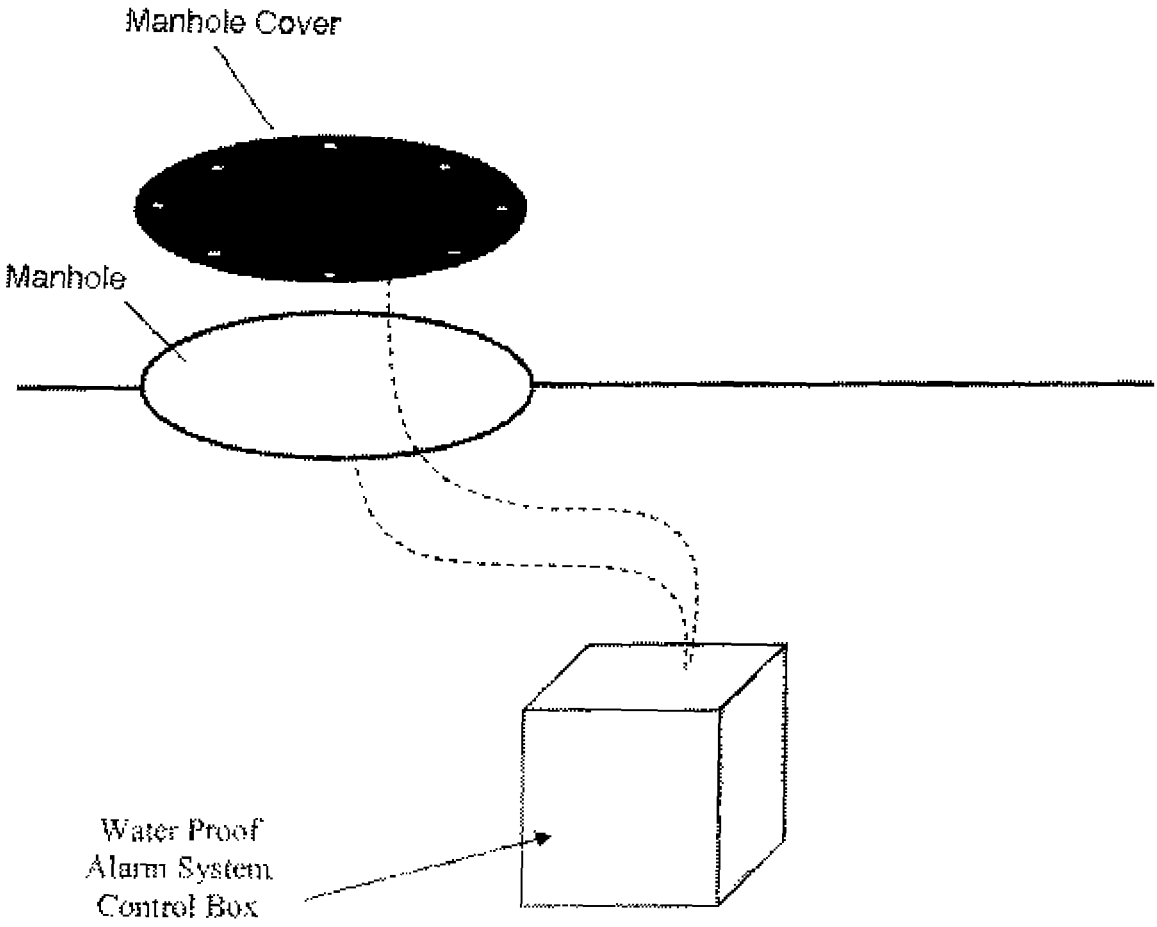
FIG. 1 is a perspective schematic representation of an antitheft alarm system for manhole cover of the open-circuit type.

The present invention provides for a monitoring system that includes one or more monitoring devices, positioned in sewer manholes, storm drains, etc., and a remote monitoring station that communicates wirelessly therewith. The monitoring device may be an integrated unit, including sensors, a power supply, a processor, and supporting hardware, all located in an enclosed, waterproof housing. Individual sensor modules are preferable battery powered for remote operation and tamper resistance. The antitheft monitoring device is placed within a manhole cavity to indicate the removal of the manhole cover and report the incident back to the remote monitoring station, which analyzes the data and responds to alert messages when a burglary incident is detected.

In the even the cover is stolen the alarm circuit detects the opening of the cover activates the wireless communication device, thus transmitting and even message to the wireless network, which in turn transmits the even message to the processing system. The processing system includes a database that stores sensor module identifiers and installed sensor module locations. An event message is used to correlate the sensor module identifier with the installed sensor location and to notify a dispatch center or other notification message recipient of the security breach event and location.

U.S. Pat. No. 4,297,663 (1981) to Seymour et al. discloses circuit breaker accessories packaged in a standardized molded case the teachings of which are incorporated herein by reference. The prior art invention discloses various circuit breaker accessories, such as a shunt trip, an under voltage release, an auxiliary switch, and a bell alarm, individually packaged in a standardized molded insulative accessory case for ultimate factory or even field installation in a molded case, automatic power circuit breaker.

The most basic burglar alarm is a simple electric circuit built into an entry way. In any circuit, whether it's powering a flashlight or a computer, electricity only flows when it is given a path between two points of opposite charge. To turn the electricity on or off, part of the circuit is opened or closed.

To open or close a flashlight circuit, a simple switch is used. In a burglar alarm, the switch detects the act of opening the manhole cover. These sorts of alarms are divided into two categories:

(1) In a closed-circuit system, the electric circuit is closed when the cover is shut (i.e. in place). This means that as long as the cap is closed, electricity can flow from one end of the circuit to the other. But if the cap is removed, the circuit is opened, and electricity can't flow. This triggers an alarm.

(2) In an open-circuit system, opening the manhole closes the circuit, so electricity begins to flow. In this system, the alarm is triggered when the circuit is completed There are a number of ways to build this sort of circuit into an entry way. Closed circuits are normally a better choice than open circuits because an intruder can deactivate the open-circuit by simply cutting the connected wires. In addition, this method is more preferred since it saves power as the batter power flows only when the cap is opened whereas the battery power flows continuously in a closed-circuit system.

A magnetic sensor in a closed circuit consists of a few simple components. For the most basic design, what is needed is: a batter powering a circuit, a spring-driven metal switch built into a manhole frame rim, a magnet embedded in the manhole, lined up with the switch, and a separately-powered buzzer with a relay-driven switch. When the manhole cover is closed, the magnet pulls the metal switch closed so the circuit it complete. The current powers the relay's electromagnet, so the buzzer circuit stays open. When you move the magnet by opening the door, the spring snaps the switch back into the open position. This cuts off the current and closes the relay, sounding the alarm. This sort of system can also be built into a manhole. If a burglar removes a manhole cover, the magnet slides out of line with the switch, and the buzzer is activated.

Another simple burglar alarm uses a small button as the switch. The button is embedded in the manhole frame rim, so closing the manhole pushes it in. When someone opens the manhole, the button is released, changing the circuit and sounding the alarm.

The alarm may further be connected to a locking mechanism such that it is switched on/off when the locking mechanism is opened.

Yet another alarm system may use a heat sensor to detect burglary using a torch to cut open the manhole cover.

With just a battery and buzzer, these designs make for fairly flawed security systems since the burglar only needs to close the manhole cover again to turn the buzzer off. That's why most modern burglar alarms incorporate another piece into the circuit—the control box.

The control box is hooked up to one or more alarm circuits, but it also has its own power supply. It monitors the circuits and sounds the alarm when they are closed or opened (depending on the design). But once the alarm is triggered, the control box won't cut it off until somebody enters a security code at a connected keypad. For added security, the control box is usually positioned in an out-of-the-way spot (such as inside the manhole cavity), so the intruder can't find it and attempt to destroy it.

Using this basic concept, it is possible to create all sorts of alarm systems. Just imagine what a burglar might do to steal a manhole, and then turn that action into the circuit switch. If a burglar removes the manhole cover, the circuit is broken, and the alarm is triggered.

There are several things a security system might do when it detects a manhole-cover burglary. In an advanced system, the control box will be wired to several different components. Typically, it will activate: (a) a siren or other loud alarm noise, (b) flashing outdoor lights, (c) a telephone auto-dialer.

The siren and lights serve three functions: (a) They alert neighbors and passer-by of a burglary attempt on the manhole cover, (b) They drive the burglar away, (c) They signal to police which manhole is under burglary attempt.

The telephone auto-dialer can: (a) Dial the police directly, and play a pre-recorded message giving the address or location of the manhole and any other relevant information. This message will usually play over and over so that the police will still hear it even if the call is put on hold for some time. (b) Dial the security company that installed the equipment. In this case, the control box can feed specific information about the intrusion—which circuits or motion detectors were activated, etc. The security company then relays this information to the police.

DESCRIPTION OF PREFERRED EMBODIMENTS

The above and other aspects, features, and advantages of the present invention will be better and more fully understood by reference to the following detailed and more particular description of the invention, which is provided to further define the invention and are in no way meant to limit the scope of the invention to the particulars of these examples.

In one embodiment of the present invention by referring to the accompanying drawings and in particular to FIG. 1, a manhole cover antitheft alarm system constructed in accordance with the present invention comprises a simple burglar alarm uses a wire connection as the switch. One wire is connected to the manhole and the other is connected to the manhole frame rim, so closing the manhole forms a closed circuit. When the two wires are connected this forms a closed circuit which means the cover is placed in place. When the wires are disconnected this means the cover is removed. When a burglar removes the manhole cover, the wires are disconnected, changing the circuit and sounding the alarm. The alarm system according to the present invention further includes a wireless transmitter located beneath the cap inside the manhole and activates a transmitted signal upon removal of said cap. The signal is sent from the control box via wireless signals to a control center which manually/automatically checks with scheduled maintenance. If the manhole cover is not scheduled for maintenance then security are manually/automatically informed to take action. Each manhole has an alarm ID to show exact location to track burglars.

Figure 2:
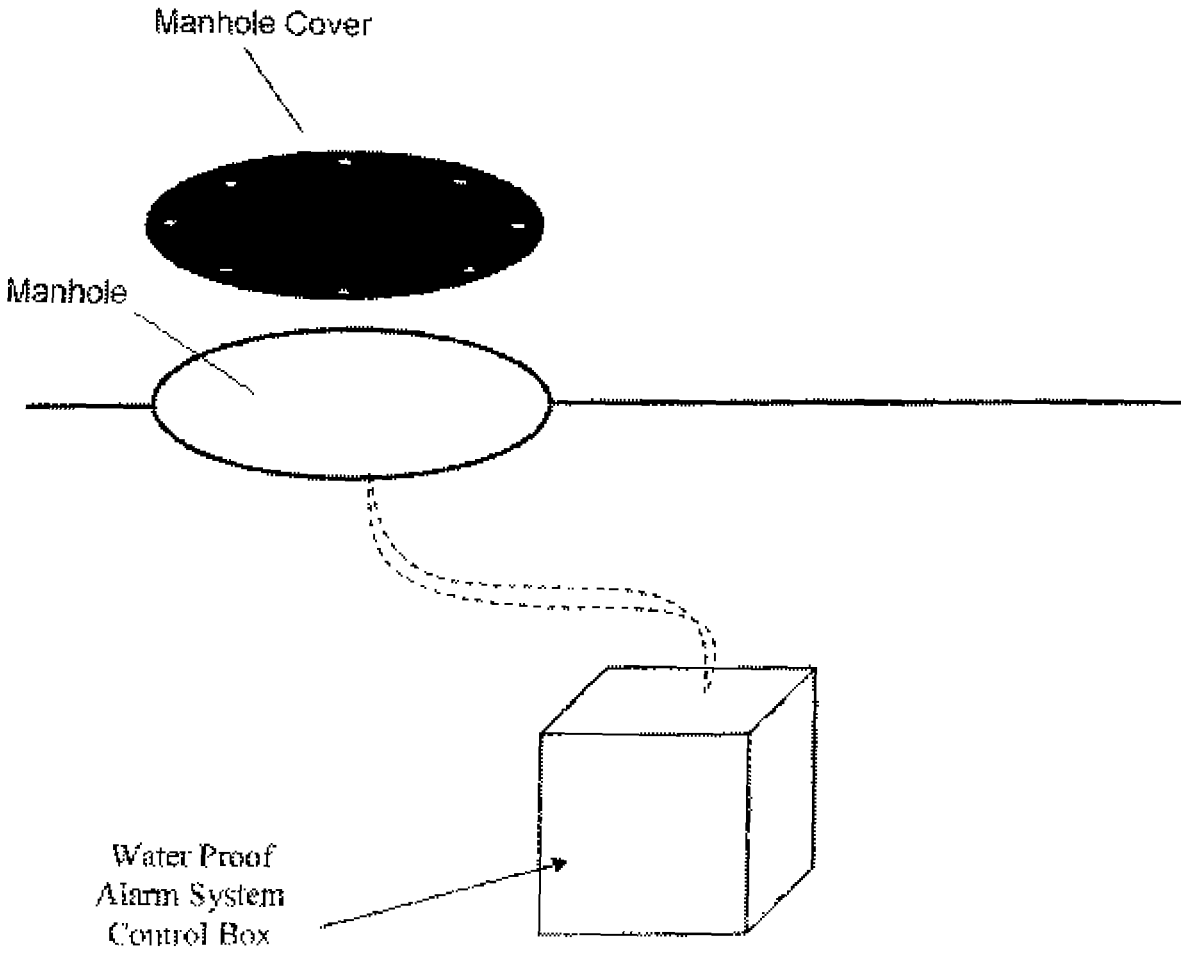
FIG. 2 is a perspective schematic representation of an antitheft alarm system for manhole cover of the closed-circuit type for use with button-switch, magnetic-switch, and heat sensor type alarm systems.
Figure 3:
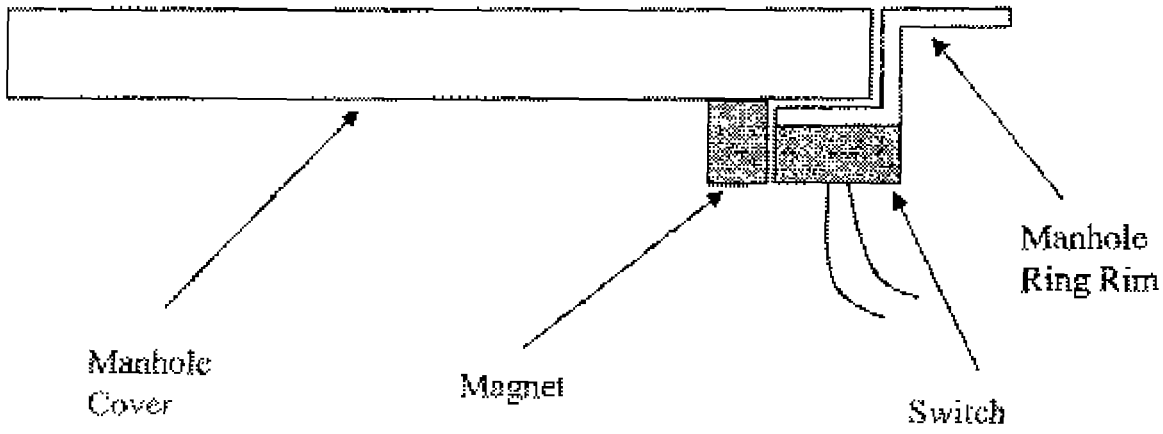
FIG. 3 is a perspective schematic representation of an antitheft alarm system for manhole cover of the closed-circuit type with magnetic sensor.

In a second embodiment of the present invention also by referring to the accompanying drawings and in particular to FIGS. 2 and 3, a manhole cover antitheft alarm system constructed in accordance with the present invention comprises a simple burglar alarm uses a push button as the switch. Both wires are connected to a switch placed on a support member attached to the manhole frame rim and beneath the manhole cover such that closing the manhole pushes the button down and opens the circuit. When a burglar removes the manhole cover the button on the switch moves (is sprung) upwards and the wires connected changing the circuit and sounding the alarm. A miniature wireless transmitter can be installed beneath the cap to transmit an alarm signal when the cap is removed. The signal is sent from the control box via wireless signals to a control center which manually/automatically checks with scheduled maintenance. If the manhole cover is not scheduled for maintenance then security are manually/automatically informed to take action.

Figure 4:
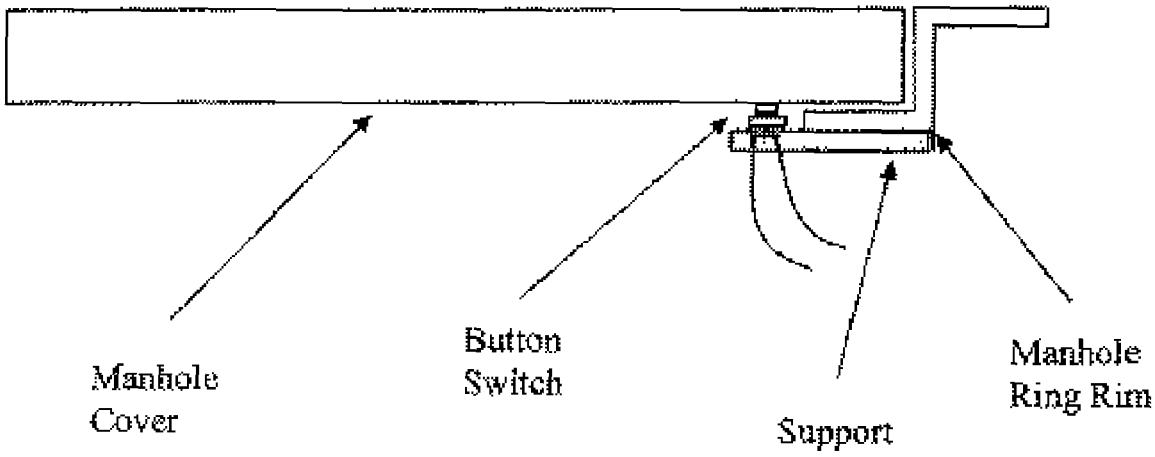
FIG. 4 is a perspective schematic representation of an alternate antitheft alarm system for manhole cover of the closed-circuit type with button-switch.
Figure 5:
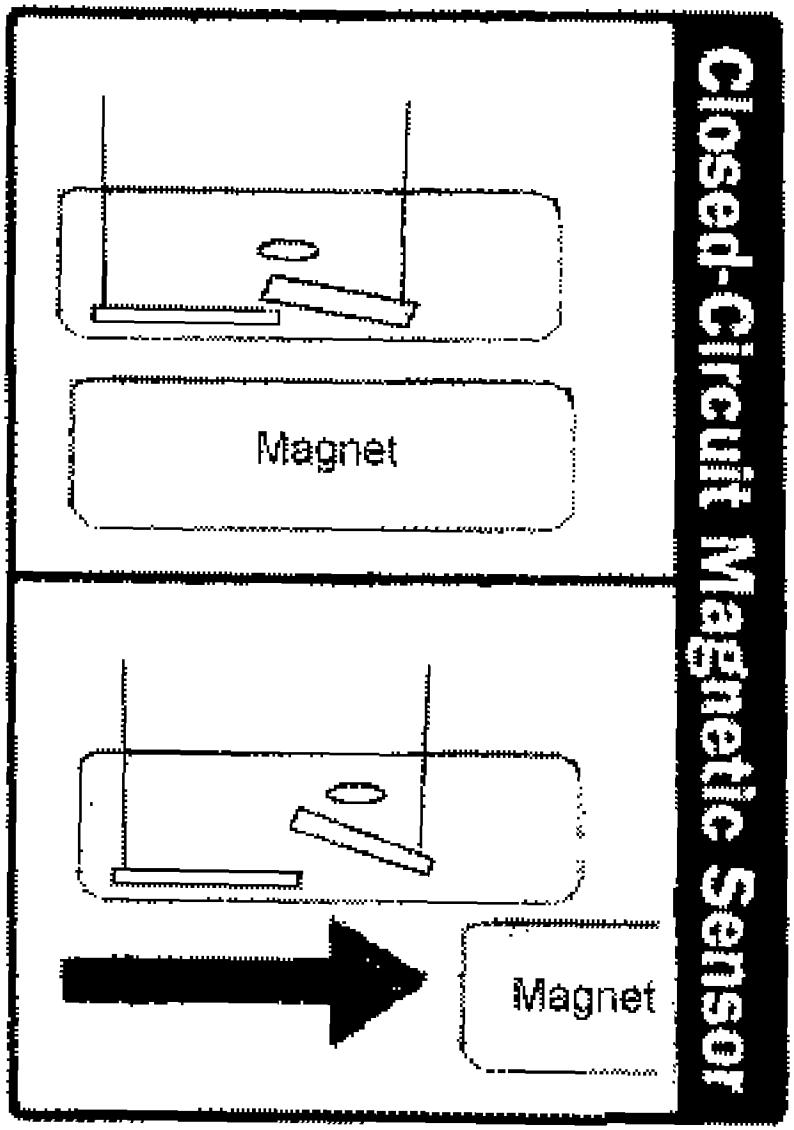
FIG. 5 illustrates is a perspective schematic view of a magnetic sensor for use in antitheft alarm system for manhole cover of the closed-circuit type.
Figure 6:
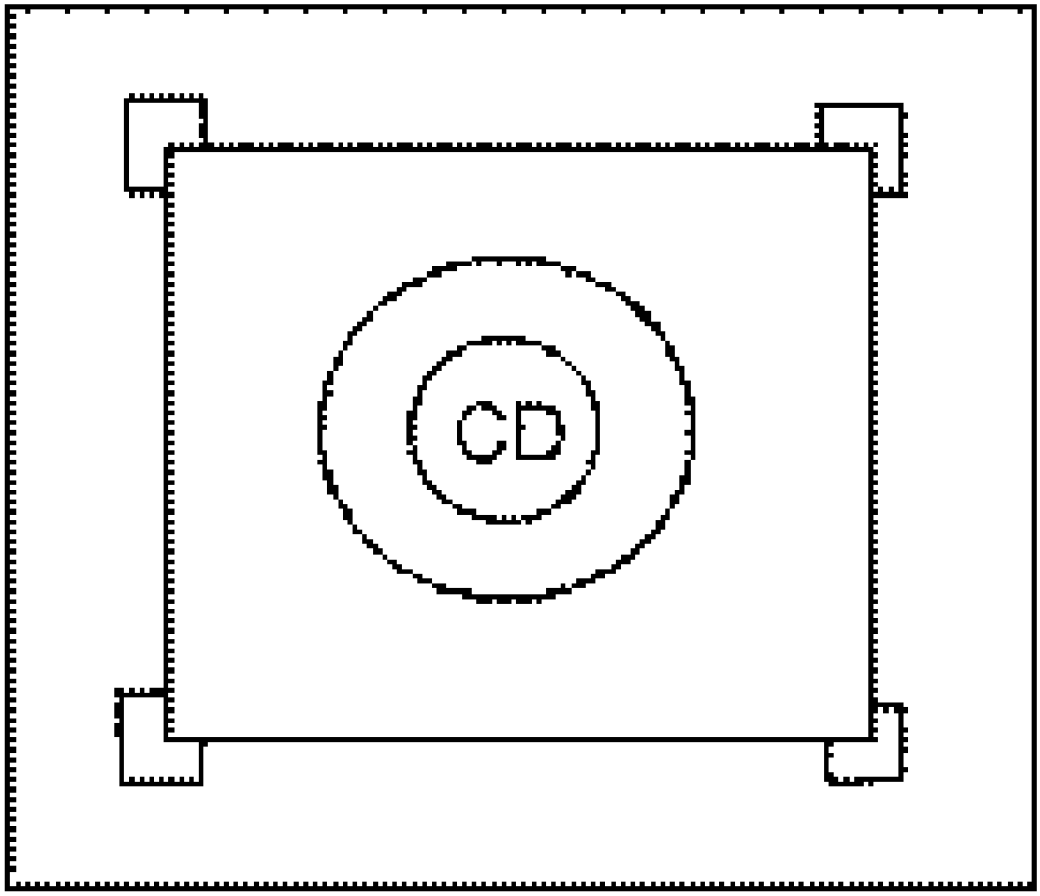
FIG. 6 illustrates a prior art antitheft manhole cover with mechanical locking mechanism.

In a third embodiment of the present invention also by referring to the accompanying drawings and in particular to FIGS. 2, 4 and 5, a manhole cover antitheft alarm system constructed in accordance with the present invention comprises a simple burglar alarm uses a magnetic sensor comprising a magnetic switch. Both wires are connected to the switch fixedly supported attached to the manhole frame rim. A magnet is placed beneath the manhole cover such that closing the manhole enable the magnet to pull the switch and opens the circuit. When a burglar removes the manhole cover the magnet is no longer aligned with the switch and the switch moves shut and the wires connected changing the circuit and sounding the alarm. A miniature wireless transmitter can be installed beneath the cap to transmit an alarm signal when the cap is removed. The signal is sent from the control box via wireless signals to a control center which manually/automatically checks with scheduled maintenance. If the manhole cover is not scheduled for maintenance then security are manually/automatically informed to take action.

In a forth embodiment of the present invention also by referring to the accompanying drawings and in particular to FIG. 2, a manhole cover antitheft alarm system constructed in accordance with the present invention comprises a simple burglar alarm uses a heat sensor. The sensor comprises two heat sensing electrodes connected to the manhole cover such that when a burglar uses a torch to cut-open the manhole cover, heat is sensed and the difference in voltage produced by the two heat sensing electrodes creates an electric current that flows to the control box sounding the alarm. A miniature wireless transmitter can be installed beneath the cap to transmit an alarm signal when the cap is removed. The signal is sent from the control box via wireless signals to a control center which manually/automatically checks with scheduled maintenance. If the manhole cover is not scheduled for maintenance then security are manually/automatically informed to take action.

Security alarm system is a rapidly growing field, and there are new and improved burglar alarms popping up all the time. For the most part, these systems are all built around the same basic structure. Any other alarm system and installation technique may be used for the purpose of the present invention.

Advantages of the Present Invention (1) The system is very effective as burglars usually take time stealing almost 100 manhole covers one at a time and place them in the car. This process is long enough to allow the security officers to track the ID number and location of the manhole covers under burglary and catch the burglars during the act as the burglary is in progress.

(2) The invention provides safety, security, and piece of mind for the society; (a) The invention can help apprehend the burglars and reduce such crimes in the future by deterring burglars, (b) can help reduce personal injuries and accidents resulting from falling into the open manholes, (c) can help reduce loss and property damage resulting from accidents initiated by the open manholes.

(3) The invention reduces the cost of multiple thefts and replacements of the manhole covers and can further be installed to existing manhole systems without change in infrastructure.

Expected Problems and Solutions.

(1) Initial and running cost.

(2) Technical problems usually associated with wireless communication devices, electronic hardware and power (batteries).

DISCLAIMERS

Although the present invention has been described with reference to the preferred embodiment thereof, it is apparent to those skilled in the art that a variety of modifications and changes may be made without departing from the scope of the present invention which is intended to be defined by the appended claims.

Those skilled in the art will recognize that when automatic operation is required a maintenance schedule is programmed into the system to automatically trigger the alarm when no maintenance job is scheduled for the manhole cover. This does not require significant modification by those skilled in the art.

Those skilled in the art will easily recognize that the manhole cover antitheft alarm system of the present invention maybe integrated with or incorporated into other automatic/manual devices and new installation techniques that provide antitheft alarm using technology available to the skilled in the art without further experimentation.

The skilled in the art will further recognize that the manhole cover antitheft alarm system of the present invention be comprised of other specific alarm devices and installation techniques that provide antitheft alarm using technology available to the skilled in the art without further experimentation and are all claimed under the scope of this invention.

The methods of the present invention have been explained with reference to plurality of references the teachings of which are all incorporated herein by reference.

EQUIVALENTS

From the foregoing description, one skilled in the art can easily ascertain the essential characteristics of this invention and, without departing from the spirit and scope thereof, can make various changes and modifications of the invention to adapt it to various usages and conditions. Such variations and changes may include, for example, altering the number of components in the housing or using equivalents. It is believed that such can be accomplished without excessive experimentation. In any case, any such variations are all claimed under the scope of this invention.

This invention has been described hereinabove, although with reference to a plurality of illustrative and preferred embodiments, it is to be understood that is in no way to be construed as limiting but only to provide examples. However, it is readily appreciated that, from reading this disclosure, the invention may be embodied in other specific forms without departing from the spirit or essential characteristics or attributes to bring modifications by replacing some elements of this invention as practiced by their equivalents, which would achieve the same goal thereof and accordingly reference should be made to the appended claims, rather than to the foregoing specification, as indicating the scope of the invention. Accordingly, those skilled in the art will recognize or be able to ascertain, using no more than routine experimentation, many equivalents to the specific embodiments and the scope of the invention being indicated by the appended claims described herein. Such equivalents, obvious variations, and all changes which come within the meaning and equivalency of the claims are therefore intended to be encompassed therein and are deemed covered by the claims of this invention.

From the foregoing description, one skilled in the art can easily ascertain the essential characteristics of this invention and, without departing from the spirit and scope thereof, can make various changes and modifications of the invention to adapt it to various usages and conditions. Such variations and changes may include, for example, altering the number of components in the housing or using equivalents. It is believed that such can be accomplished without excessive experimentation. In any case, any such variations are all claimed under the scope of this invention.

I claim:

1. A manhole cover antitheft alarm system, comprising:

a switch mounted on a rim of a manhole;

means for generating a signal when said switch is opened by removal of a manhole cover from the manhole; and means for transmitting the signal to a remote base to alert personnel of the removal of the manhole cover, said signal including identification information representative of the location of the manhole.

2. The manhole cover antitheft alarm system as recited in claim 1, wherein said means for transmitting the signal comprises a wireless transmitter.

3. The manhole cover antitheft alarm system as recited in claim 1, further comprising means for comparing a time of signal generation with a pre-recorded maintenance schedule.

4. The manhole cover antitheft alarm system as recited in claim 3, wherein said switch comprises a magnetic switch, a magnet being mounted to a lower surface of the manhole cover such that said magnet is adjacent the magnetic switch when the manhole cover is mounted on the rim of the manhole.

5. The manhole cover antitheft alarm system as recited in claim 3, wherein said switch comprises a push-button switch, such that the push-button switch is closed when the manhole cover is mounted on the rim of the manhole.

6. A manhole cover antitheft alarm system, comprising:

a switch mounted on a rim of a manhole;

means for generating a signal when said switch is opened by removal of a manhole cover from the manhole;

means for transmitting the signal to a remote base to alert personnel of the removal of the manhole cover; and means for comparing a time of signal generation with a pre-recorded maintenance schedule.

7. The manhole cover antitheft alarm system as recited in claim 6, wherein said means for transmitting the signal comprises a wireless transmitter.

8. The manhole cover antitheft alarm system as recited in claim 6, wherein said signal includes identification information representative of the location of the manhole.

9. The manhole cover antitheft alarm system as recited in claim 8, wherein said switch comprises a magnetic switch, a magnet being mounted to a lower surface of the manhole cover such that said magnet is adjacent the magnetic switch when the manhole cover is mounted on the rim of the manhole.

10. The manhole cover antitheft alarm system as recited in claim 8, wherein said switch comprises a push-button switch, such that the push-button switch is closed when the manhole cover is mounted on the rim of the manhole.

* * * * *